US012687160B2

(12) United States Patent
Chou et al.

(10) Patent No.: US 12,687,160 B2
(45) Date of Patent: Jul. 21, 2026

(54) AIR COMPRESSOR

(71) Applicant: UNIK WORLD INDUSTRIAL CO., LTD., Tainan City (TW)

(72) Inventors: Wen San Chou, Tainan City (TW); Cheng Hsien Chou, Tainan City (TW)

(73) Assignee: UNIK WORLD INDUSTRIAL CO., LTD., Tainan City (TW)

( * ) Notice: Subject to any disclaimer, the term of this patent is extended or adjusted under 35 U.S.C. 154(b) by 0 days.

(21) Appl. No.: 18/674,888

(22) Filed: May 26, 2024

(65) Prior Publication Data

US 2025/0347273 A1 Nov. 13, 2025

Related U.S. Application Data

(60) Provisional application No. 63/567,401, filed on Mar. 19, 2024.

(30) Foreign Application Priority Data

May 9, 2024 (TW) ..... 113117152

(51) Int. Cl.
*F04B 39/06* (2006.01)
*F04B 35/01* (2006.01)

(52) U.S. Cl.
CPC ..... *F04B 39/06* (2013.01); *F04B 35/01* (2013.01)

(58) Field of Classification Search
CPC ..... F04C 2210/1005; F04C 2240/30; F04C 29/04; F04D 25/08; F04D 25/082; F04D 29/5806; F04D 25/16; F04D 25/166; F04D 29/281; F04D 29/584; F04D 13/06; F04B 35/00; F04B 27/0423; F04B 1/0536; F04B 39/0094
See application file for complete search history.

(56) References Cited

U.S. PATENT DOCUMENTS

2016/0265541 A1* 9/2016 Chou ..... F04B 39/121

FOREIGN PATENT DOCUMENTS

| | | |
|---|---|---|
| CN | 114087158 | 2/2022 |
| CN | 218542522 | 2/2023 |
| JP | 2004342147 A | 12/2004 |

(Continued)

OTHER PUBLICATIONS

"Office Action of Taiwan Counterpart Application", issued on Feb. 8, 2025, p. 1-p. 7.

(Continued)

*Primary Examiner* — Anthony Ayala Delgado
(74) *Attorney, Agent, or Firm* — JCIPRNET

(57) ABSTRACT

An air compressor includes a cylinder, a frame, a gear set, a motor, a piston, a first cooling fan, and at least one second cooling fan. The frame is connected to the cylinder. The gear set includes a first gear, a second gear, and at least one third gear. The second gear is pivotally connected to the frame and engaged between the first gear and the third gear. The third gear is pivotally connected to the frame. The motor is connected to the first gear. A first end of the piston is disposed in the cylinder, and a second end of the piston is connected to the second gear. The first cooling fan is connected to the motor. The second cooling fan is connected to the third gear. The motor drives the first cooling fan to rotate, and drives the piston and the second cooling fan by the gear set.

8 Claims, 8 Drawing Sheets

(56) References Cited

FOREIGN PATENT DOCUMENTS

| | | |
|---|---|---|
| JP | 5096510 | 12/2012 |
| JP | 2015217756 | 12/2015 |
| JP | 2020065317 | 4/2020 |
| TW | M663607 | 12/2024 |

OTHER PUBLICATIONS

"Notice of Reasons for Refusal of Japan Counterpart Application", issued on Jul. 8, 2025, p. 1-p. 2.
"Office Action of Japan counterpart Application", issued on Oct. 23, 2025, p. 1-p. 2.
"Office Action of Japan Counterpart Application", issued on Jan. 30, 2026, p. 1.

* cited by examiner

AIR COMPRESSOR

CROSS-REFERENCE TO RELATED APPLICATION

This application claims the priority benefit of U.S. provisional application Ser. No. 63/567,401, filed on Mar. 19, 2024, and Taiwan application serial no. 113117152, filed on May 9, 2024. The entirety of each of the above-mentioned patent applications is hereby incorporated by reference herein and made a part of this specification.

BACKGROUND

Technical Field

This disclosure relates to an air compressor, and in particular to a piston type air compressor.

Description of Related Art

Vehicle-mounted air compressor can be used with a tire sealant bottle to repair and inflate vehicle tires, and can also be used to inflate vehicle tires without a tire sealant bottle. The air compressor may be a piston type air compressor, in which the piston advances within the cylinder to compress the air in the cylinder, thereby allowing high-pressure air to flow out of the front end of the cylinder. When the piston moves backward in the cylinder, the space in the cylinder gradually becomes larger and the air pressure inside the cylinder decreases, and is compressed the next time the piston advances, thus continuing the cycle. The piston type air compressor heats up when operating, so a cooling fan is usually installed coaxially with the motor used to drive the piston. However, due to the compact internal configuration and narrow space of the air compressor, which results in poor cooling airflow efficiency, the above heat dissipation design cannot effectively achieve sufficient heat dissipation.

SUMMARY

The disclosure provides an air compressor with good heat dissipation efficiency.

The air compressor of the disclosure includes a cylinder, a frame, a gear set, a motor, a piston, a first cooling fan, and at least one second cooling fan. The frame is connected to the cylinder. The gear set includes a first gear, a second gear, and at least one third gear. The second gear is pivotally connected to the frame and engaged between the first gear and the third gear. The third gear is pivotally connected to the frame. The motor is connected to the first gear. A first end of the piston is disposed in the cylinder, and a second end of the piston is connected to the second gear. The first cooling fan is connected to the motor. The second cooling fan is connected to the third gear. The motor is adapted to drive the first cooling fan to rotate, is adapted to drive the first end of the piston to reciprocate along the cylinder by the gear set, and is adapted to drive the second cooling fan to rotate by the gear set.

In an embodiment of the disclosure, the second cooling fan includes an axial fan or a centrifugal fan.

In an embodiment of the disclosure, the first end of the piston is located in front of the second end of the piston in a forward-backward direction of the air compressor, and the first gear and the third gear overlap each other in the forward-backward direction.

In an embodiment of the disclosure, the motor and the first gear are located on opposite sides of the frame respectively.

In an embodiment of the disclosure, the second cooling fan and the third gear are located on opposite sides of the frame respectively.

In an embodiment of the disclosure, a connection line between the first gear and the at least one third gear passes through a center of the second gear.

In an embodiment of the disclosure, a connection line between the first gear and the at least one third gear does not pass through a center of the second gear.

In an embodiment of the disclosure, the air compressor further includes at least one third cooling fan. The second cooling fan and the third cooling fan are connected to opposite sides of the third gear respectively.

In an embodiment of the disclosure, the first end of the piston is located in front of the second end of the piston in a forward-backward direction of the air compressor, and the motor is located in front of the second cooling fan.

In an embodiment of the disclosure, the first end of the piston is located in front of the second end of the piston in a forward-backward direction of the air compressor, and the motor is located behind the second cooling fan.

Based on the above, in the air compressor of the disclosure, in addition to the first cooling fan that is coaxial with the motor, a second cooling fan that is not coaxial with the motor is also provided, and while the motor drives the piston, it can drive the first cooling fan and the second cooling fan to rotate at the same time. Accordingly, the first cooling fan and the second cooling fan can be used to generate heat dissipation airflow at different positions in the air compressor, thereby effectively improving heat dissipation efficiency of the air compressor. In addition, in the gear set coupled between the motor and the second cooling fan, the second gear and the third gear are pivotally connected to the same frame, so that the installation of the gear set is relatively simple, which may save manufacturing and assembly costs.

To make the aforementioned more comprehensible, several embodiments accompanied with drawings are described in detail as follows.

BRIEF DESCRIPTION OF THE DRAWINGS

The accompanying drawings are included to provide a further understanding of the disclosure, and are incorporated in and constitute a part of this specification. The drawings illustrate example embodiments of the disclosure and, together with the description, serve to explain the principles of the disclosure.

DESCRIPTION OF THE EMBODIMENTS

Figure 1:
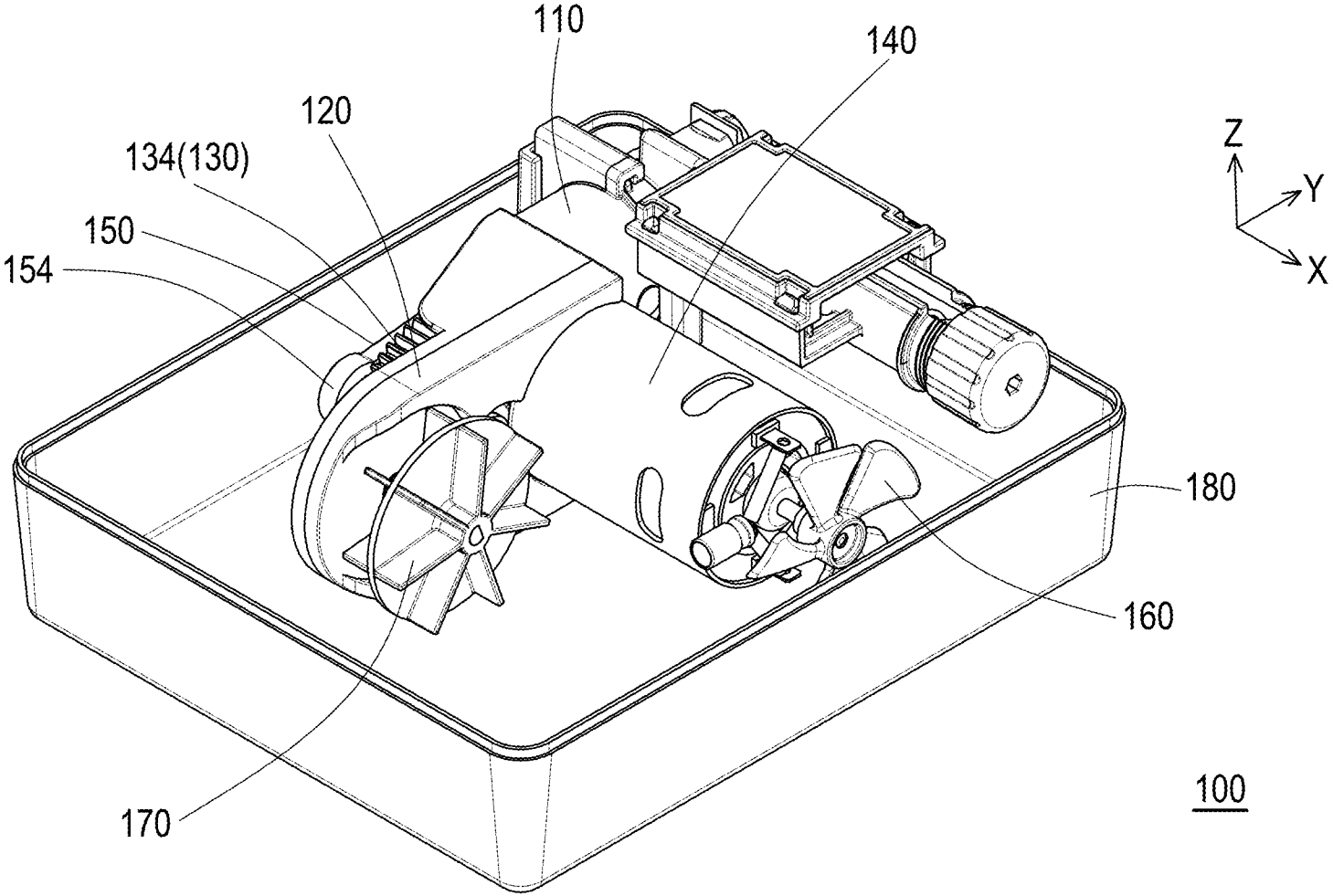
FIG. 1 is a partial structural three-dimensional view of an air compressor according to an embodiment of the disclosure.
Figure 2:
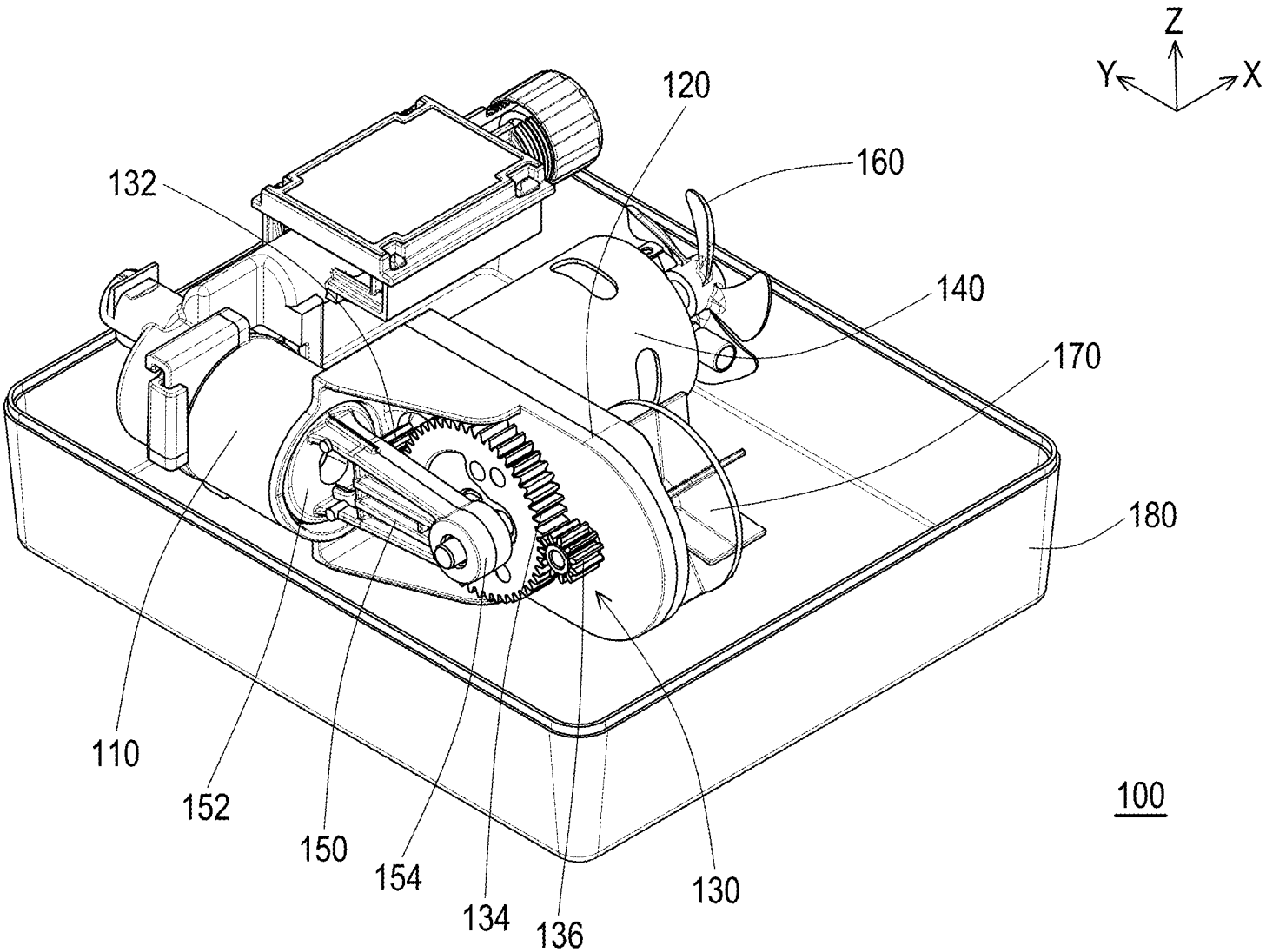
FIG. 2 is a three-dimensional view of the air compressor in FIG. 1 from another perspective.

FIG. 1 is a partial structural three-dimensional view of an air compressor according to an embodiment of the disclosure, which illustrates axial directions X, Y, and Z. FIG. 2 is a three-dimensional view of the air compressor in FIG. 1 from another perspective. Please refer to FIG. 1 and FIG. 2. An air compressor 100 of this embodiment is, for example, a vehicle-mounted air compressor, which is configured to provide high-pressure air required for inflating and/or repairing tires of the vehicle. However, the disclosure is not limited thereto. The air compressor 100 includes a housing 180, a cylinder 110, a frame 120 connected to the cylinder 110, a gear set 130, a motor 140, a piston 150, a first cooling fan 160, and a second cooling fan 170. The cylinder 110, the frame 120, the gear set 130, the motor 140, the piston 150, the first cooling fan 160, and the second cooling fan 170 are disposed in the housing 180. To make the drawings clearer, the housing 180 in FIG. 1 and FIG. 2 is depicted with only the lower portion thereof, and the housing 180 may in fact contain an undrawn upper portion to conceal the inner components thereof.

Figure 3:
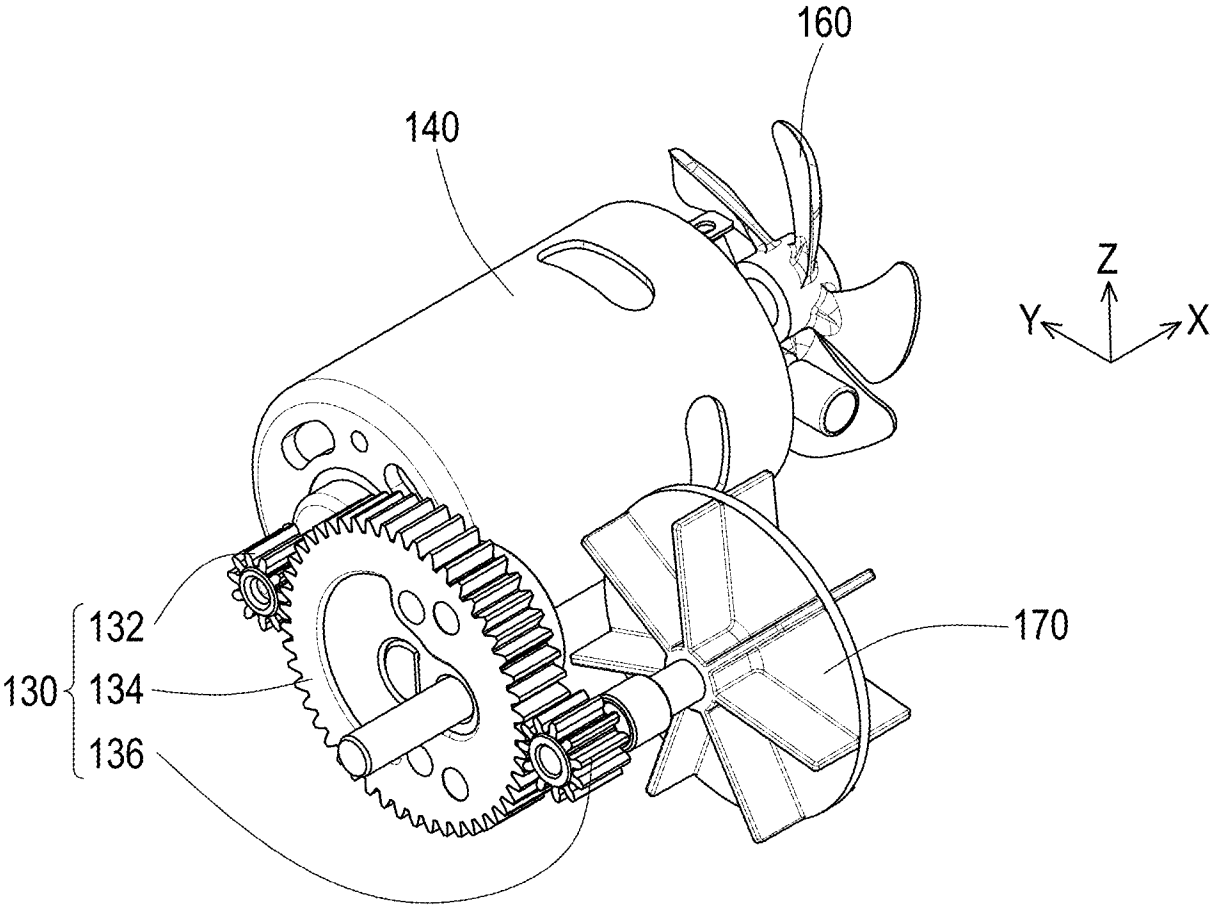
FIG. 3 is a three-dimensional view of some components of the air compressor of FIG. 2.
Figure 4:
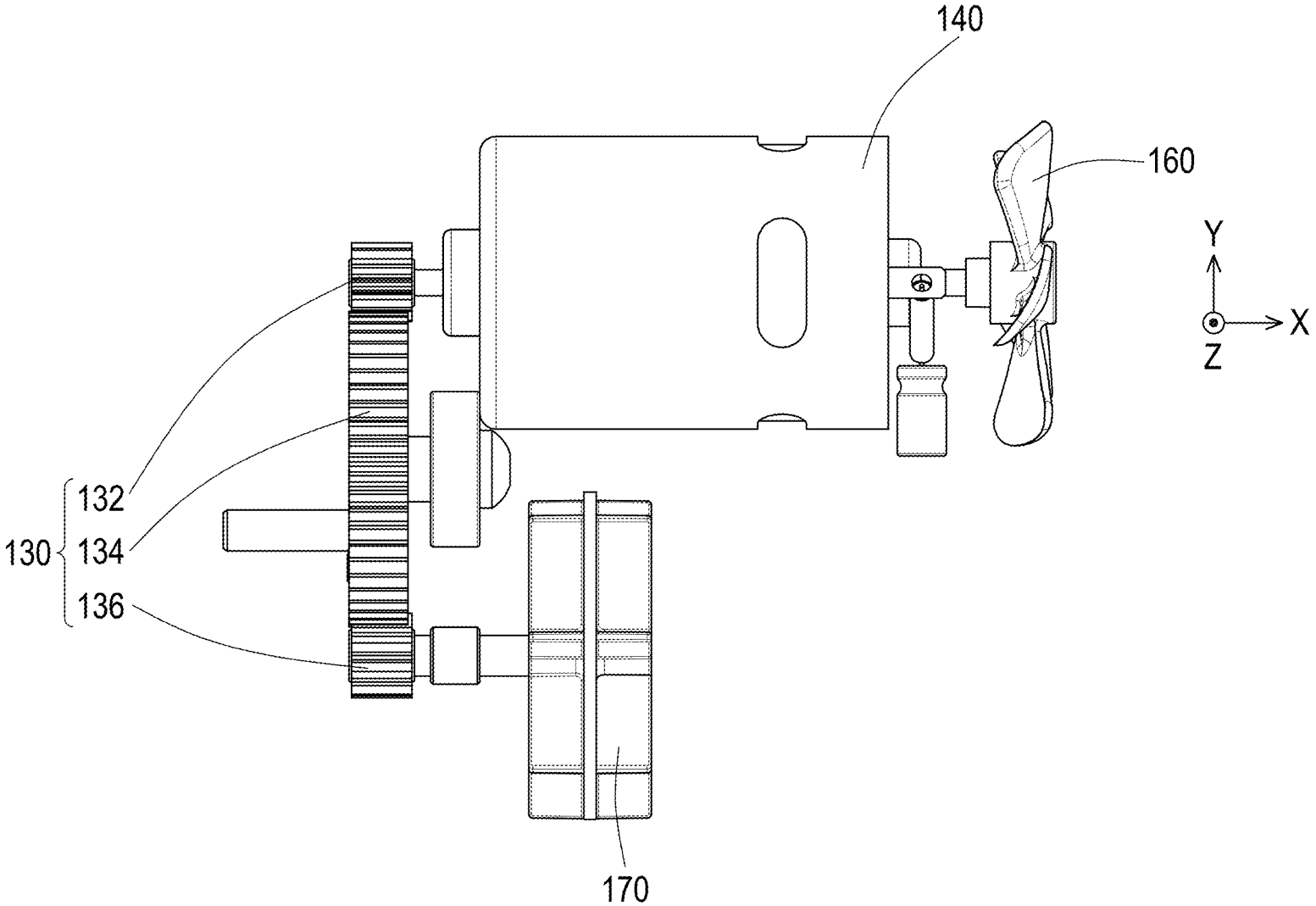
FIG. 4 is a top view of some components of the air compressor of FIG. 2.

FIG. 3 is a three-dimensional view of some components of the air compressor of FIG. 2. FIG. 4 is a top view of some components of the air compressor of FIG. 2. Please refer to FIG. 2 to FIG. 4. The gear set 130 of this embodiment includes a first gear 132, a second gear 134, and a third gear 136. The second gear 134 is, for example, a reduction gear, which is pivotally connected to the frame 120 and engaged between the first gear 132 and the third gear 136. The third gear 136 is also pivotally connected to the frame 120. Specifically, the frame 120 may have a shaft hole for the first gear 132 and the third gear 136 to pivot, and the shaft hole may be provided with a bushing or bearing to increase lubrication and wear resistance.

The motor 140 is coaxially connected to the first gear 132, and the motor 140 and the first gear 132 are located on opposite sides of the frame 120 respectively. A first end 152 of the piston 150 is disposed in the cylinder 110, and a second end 154 of the piston 150 is connected to the second gear 134. The first cooling fan 160 can be an axial fan, a centrifugal fan, or other types of fans (an axial fan is shown) and is coaxially connected to the motor 140. The second cooling fan 170 can be an axial fan, a centrifugal fan, or other types of fans (a centrifugal fan is shown) and is coaxially connected to the third gear 136. The second cooling fan 170 and the third gear 136 are located on opposite sides of the frame 120 respectively. The motor 140 is adapted to drive the first cooling fan 160 to rotate, is adapted to drive the first end 152 of the piston 150 to reciprocate along the cylinder by the gear set 130, and is adapted to drive the second cooling fan 170 to rotate by the gear set 130.

As the piston 150 advances within the cylinder 110, the air within the cylinder 110 is compressed, resulting in the high-pressure air pass through a front end of the cylinder 110. As the piston 150 moves backward in the cylinder 110, the space inside the cylinder 110 gradually becomes larger and the air pressure inside the cylinder 110 decreases. Next, when the air pressure inside the cylinder 110 is lower than a value of the pressure outside the cylinder 110, the outside air is drawn into the cylinder 110 or otherwise drawn into the cylinder 110 through an intake valve disposed in the cylinder 110 or the piston 150, and is compressed the next time the piston 150 advances, and so on in a continuous cycle. The detailed principles and methods of the piston 150 operating to output high-pressure air are known in the technical field and are not repeated in the following.

As mentioned above, in the air compressor 100 of this embodiment, in addition to the first cooling fan 160 that is coaxial with the motor 140, the second cooling fan 170 that is not coaxial with the motor 140 is also disposed, and while the motor 140 drives the piston 150, it can drive the first cooling fan 160 and the second cooling fan 170 to rotate at the same time. Accordingly, the first cooling fan 160 and the second cooling fan 170 can be used to generate heat dissipation airflow at different positions in the air compressor 100, thereby effectively improving heat dissipation efficiency of the air compressor 100. In addition, in the gear set 130 coupled between the motor 140 and the second cooling fan 170, the second gear 134 and the third gear 136 are pivotally connected to the same frame 120, so that the installation of the gear set 130 is relatively simple, which may save manufacturing and assembly costs.

In this embodiment, the first end 152 of the piston 150 is located in front of the second end 154 of the piston 150 in the forward-backward direction (axial direction Y) of the air compressor 100. The first gear 132 and the third gear 136 overlap each other in the forward-backward direction (axial direction Y).

Figure 5:
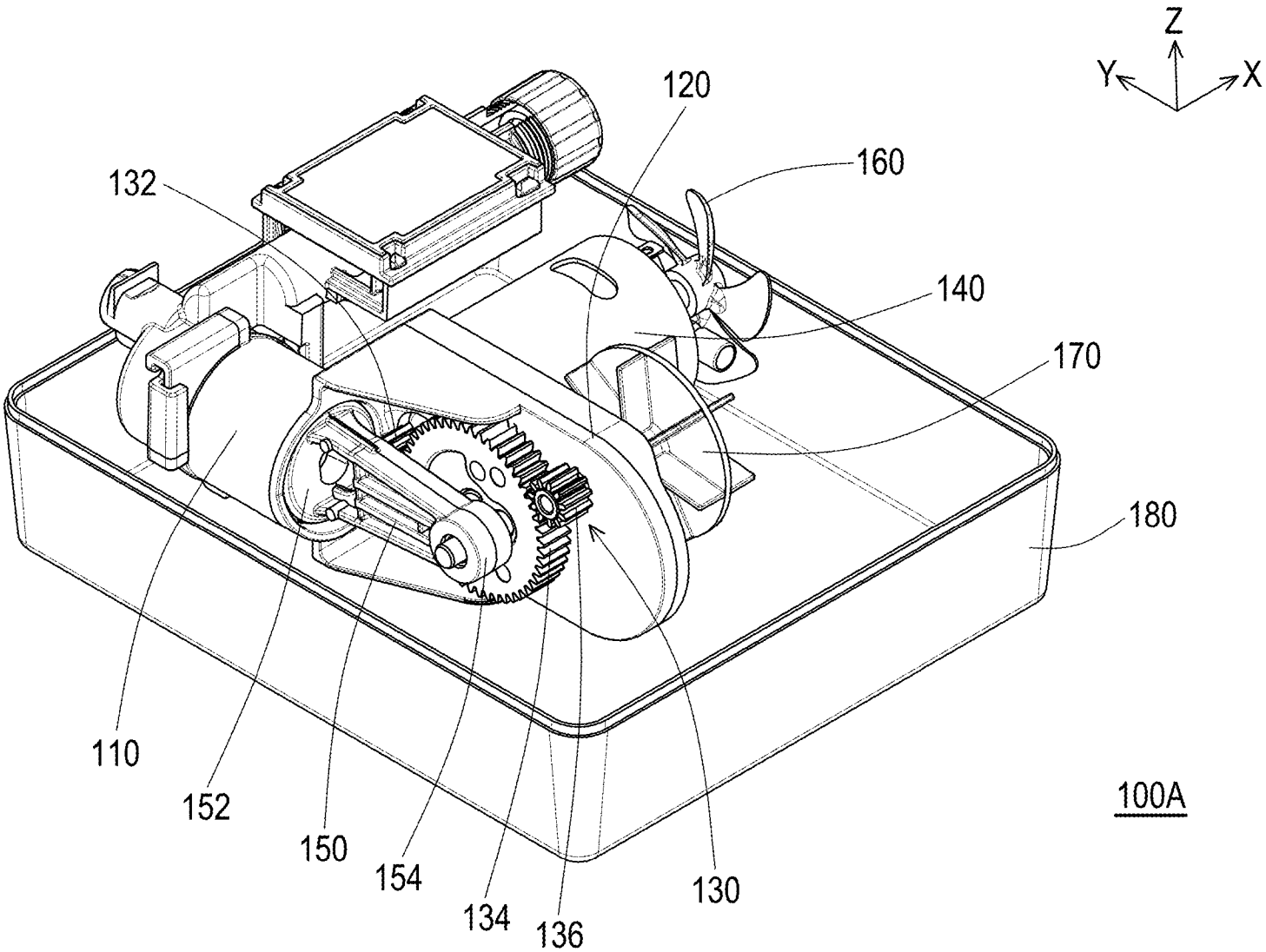
FIG. 5 is a three-dimensional view of an air compressor according to another embodiment of the disclosure.

In the embodiment shown in FIG. 1 to FIG. 4, a connection line between the first gear 132 and the third gear 136 passes through a center of the second gear 134. However, the disclosure is not limited thereto, and the installation position of the gear can be changed according to space configuration and/or cooling airflow planning considerations, as illustrated below by drawing. FIG. 5 is a three-dimensional view of an air compressor according to another embodiment of the disclosure. The difference between an air compressor 100A shown in FIG. 5 and the air compressor 100 shown in FIG. 2 is that the position of the third gear 136 in FIG. 5 is different from the position of the third gear 136 in FIG. 2, so that the connection line between the first gear 132 and the third gear 136 in FIG. 5 does not pass through the center of the second gear 134. In other embodiments, the third gear 136 may be disposed at other appropriate positions adjacent to the second gear 134, or multiple additional gears may be disposed at multiple appropriate positions adjacent to the second gear 134, and correspondingly multiple heat dissipation fans connected to each of the additional gears may be disposed to further enhance the heat dissipation effect.

Figure 6:
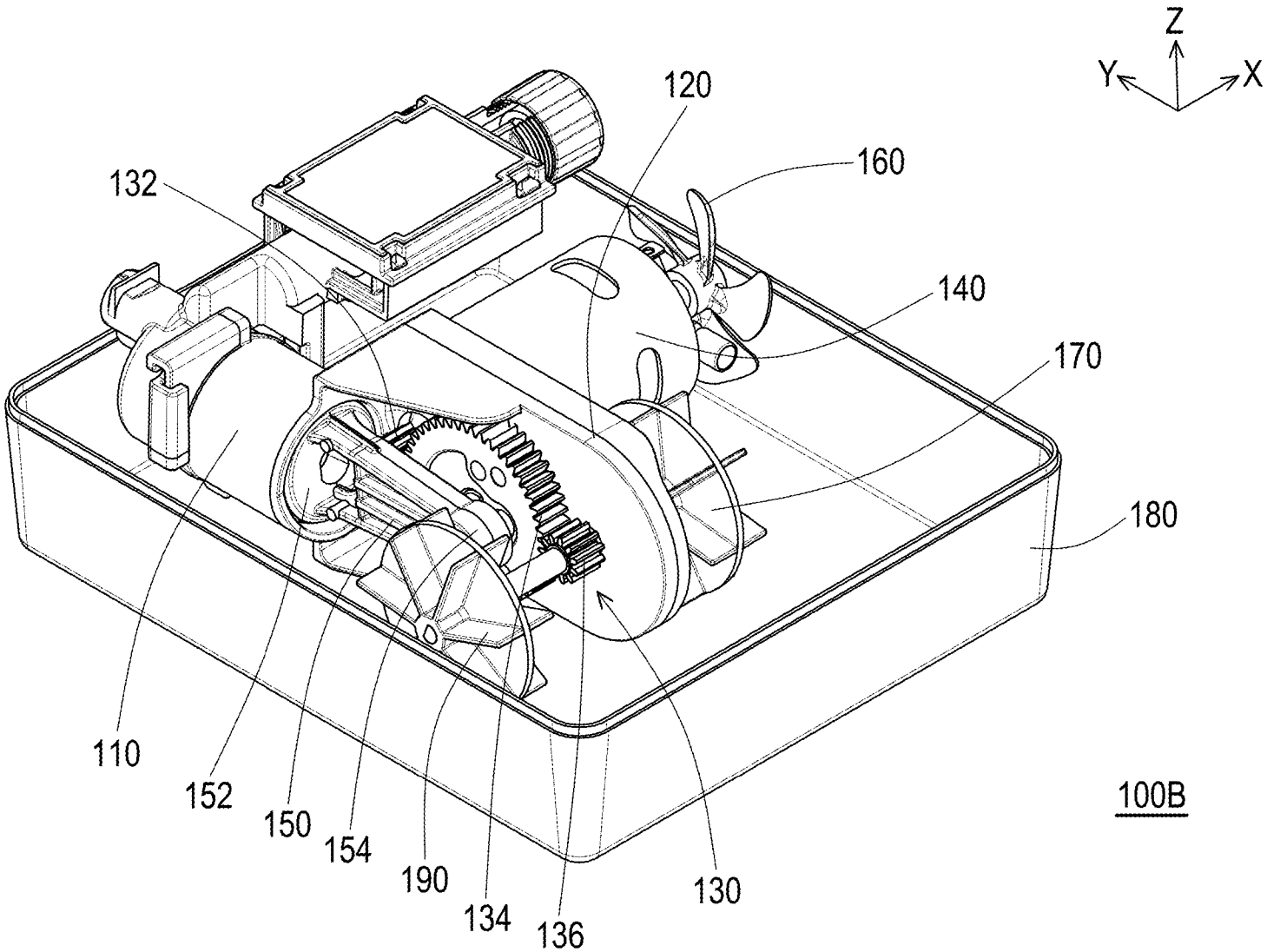
FIG. 6 is a three-dimensional view of an air compressor according to another embodiment of the disclosure.

In the embodiment shown in FIG. 1 to FIG. 4, the third gear 136 is connected to a cooling fan (the second cooling fan 170). However, the disclosure is not limited thereto, and the third gear 136 may be connected to more cooling fans according to space configuration and/or cooling airflow planning considerations, as illustrated below by drawing. FIG. 6 is a three-dimensional view of an air compressor according to another embodiment of the disclosure. The difference between an air compressor 100B shown in FIG. 6 and the air compressor 100 shown in FIG. 2 is that the air compressor 100B shown in FIG. 6 further includes a third cooling fan 190. The second cooling fan 170 and the third cooling fan 190 are respectively connected to opposite sides of the third gear 136, and can be driven by the third gear 136 to rotate at the same time.

Figure 7:
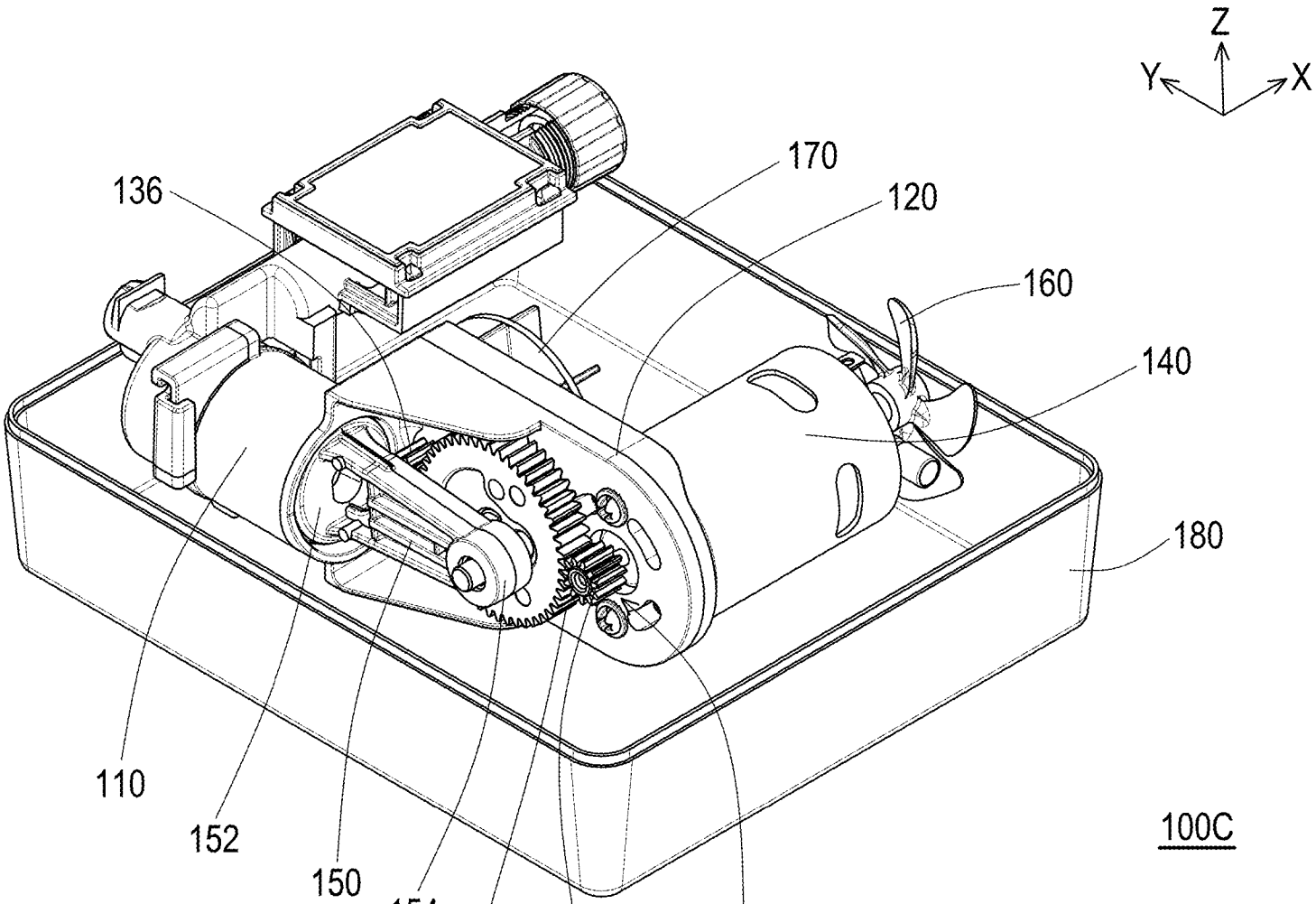
FIG. 7 is a three-dimensional view of an air compressor according to another embodiment of the disclosure.

In the embodiment shown in FIG. 1 to FIG. 4, the motor 140 is located in front of the second cooling fan 170 in the forward-backward direction (axial direction Y) of the air compressor 100. However, the disclosure is not limited thereto, and the relative positions of the motor 140 and the second cooling fan 170 can be changed according to space configuration and/or cooling airflow planning considerations, as illustrated below by drawing. FIG. 7 is a three-dimensional view of an air compressor according to another embodiment of the disclosure. The difference between an air compressor 100C shown in FIG. 7 and the air compressor 100 shown in FIG. 2 is that in the embodiment shown in FIG. 7, the motor 140 is located behind the second cooling fan 170 in the forward-backward direction (axial direction Y) of the air compressor 100C.

Figure 8:
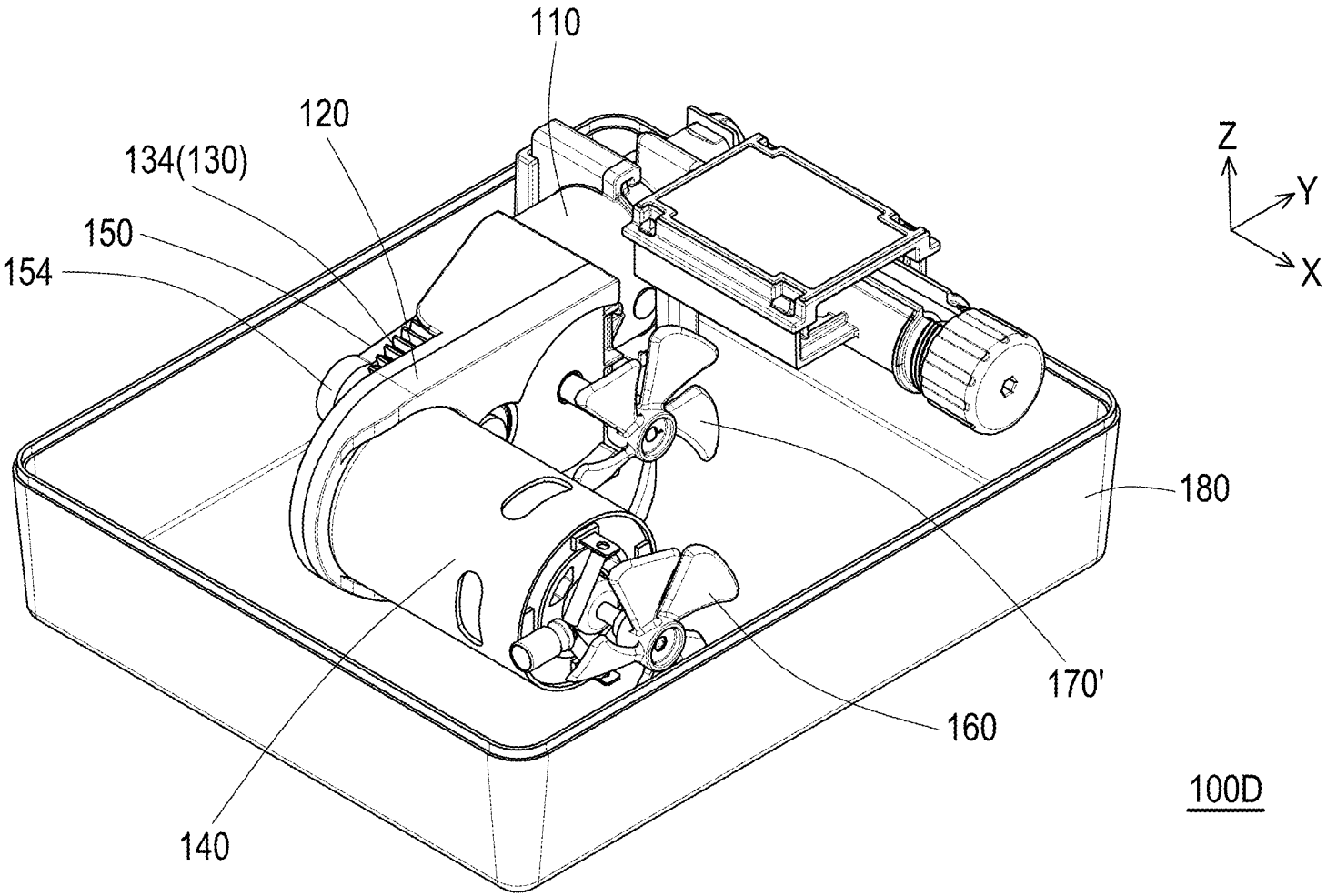
FIG. 8 is a three-dimensional view of an air compressor according to another embodiment of the disclosure.

FIG. 8 is a three-dimensional view of an air compressor according to another embodiment of the disclosure. The difference between an air compressor 100D shown in FIG. 8 and the air compressor 100C shown in FIG. 7 is that in the air compressor 100D, a second cooling fan 170' is an axial flow fan instead of the second cooling fan 170 being a centrifugal fan as in FIG. 7.

To sum up, in the air compressor of the disclosure, in addition to the first cooling fan that is coaxial with the motor, a second cooling fan that is not coaxial with the motor is also provided, and while the motor drives the piston, it can drive the first cooling fan and the second cooling fan to rotate at the same time. Accordingly, the first cooling fan and the second cooling fan can be used to generate heat dissipation airflow at different positions in the air compressor, thereby effectively improving heat dissipation efficiency of the air compressor. In addition, in the gear set coupled between the motor and the second cooling fan, the second gear and the third gear are pivotally connected to the same frame, so that the installation of the gear set is relatively simple, which may save manufacturing and assembly costs.

It will be apparent to those skilled in the art that various modifications and variations can be made to the disclosed embodiments without departing from the scope or spirit of the disclosure. In view of the foregoing, it is intended that the disclosure covers modifications and variations provided that they fall within the scope of the following claims and their equivalents.

What is claimed is:

1. An air compressor, comprising:

a cylinder;

a frame, connected to the cylinder;

a gear set, comprising a first gear, a second gear, and at least one third gear, wherein the second gear is pivotally connected to the frame and engaged between the first gear and the at least one third gear, and the at least one third gear is pivotally connected to the frame;

a motor, connected to the first gear;

a piston, a first end of the piston is disposed in the cylinder, and a second end of the piston is connected to the second gear;

a first cooling fan, connected to the motor; and at least one second cooling fan, connected to the at least one third gear, wherein the motor is adapted to drive the first cooling fan to rotate, is adapted to drive the first end of the piston to reciprocate along the cylinder by the gear set, and is adapted to drive the at least one second cooling fan to rotate by the gear set, wherein the first gear and the first cooling fan are located at different sides of the motor respectively, wherein the air compressor further comprises at least one third cooling fan, and the at least one second cooling fan and the at least one third cooling fan are connected to opposite sides of the at least one third gear respectively.

2. The air compressor according to claim 1, wherein the at least one second cooling fan comprises an axial fan or a centrifugal fan.

3. The air compressor according to claim 1, wherein the first end of the piston is located in front of the second end of the piston in a forward-backward direction of the air compressor, and the first gear and the at least one third gear overlap each other in the forward-backward direction.

4. The air compressor according to claim 1, wherein the motor and the first gear are located on opposite sides of the frame respectively.

5. The air compressor according to claim 1, wherein the at least one second cooling fan and the at least one third gear are located on opposite sides of the frame respectively.

6. The air compressor according to claim 1, wherein a connection line between the first gear and the at least one third gear passes through a center of the second gear.

7. The air compressor according to claim 1, wherein a connection line between the first gear and the at least one third gear does not pass through a center of the second gear.

8. The air compressor according to claim 1, wherein the first end of the piston is located in front of the second end of the piston in a forward-backward direction of the air compressor, and the motor is located in front of the at least one second cooling fan.

* * * * *